US007975623B1

(12) United States Patent
Gassick et al.

(10) Patent No.: US 7,975,623 B1
(45) Date of Patent: Jul. 12, 2011

(54) SERVING TRAY SYSTEMS

(76) Inventors: Robert Gassick, Cottonwood, AZ (US); Kristin N. Gassick, Cottonwood, AZ (US)

( * ) Notice: Subject to any disclaimer, the term of this patent is extended or adjusted under 35 U.S.C. 154(b) by 159 days.

(21) Appl. No.: 12/139,470

(22) Filed: Jun. 14, 2008

Related U.S. Application Data

(60) Provisional application No. 60/943,904, filed on Jun. 14, 2007.

(51) Int. Cl.
*A47B 37/00* (2006.01)

(52) U.S. Cl. ..... 108/43; 248/444

(58) Field of Classification Search ..... 108/43, 108/42, 16, 49; 206/518, 557, 556; 248/444; 294/172; 220/608
See application file for complete search history.

(56) References Cited

U.S. PATENT DOCUMENTS

| | | | | | |
|---|---|---|---|---|---|
| 425,709 | A | * | 4/1890 | Schilling | 108/28 |
| 1,370,811 | A | * | 3/1921 | Harding et al. | 206/563 |
| 2,271,294 | A | * | 1/1942 | Ford | 248/444 |
| 3,013,818 | A | * | 12/1961 | Plotzker et al. | 108/43 |
| D194,114 | S | * | 11/1962 | Graham | D7/549 |
| 3,162,344 | A | * | 12/1964 | Sabol | 294/143 |
| 3,504,832 | A | * | 4/1970 | Corvetti | 294/144 |
| 3,941,286 | A | | 3/1976 | Perkinson | |
| 3,955,672 | A | * | 5/1976 | Brundage | 206/562 |
| 4,653,808 | A | * | 3/1987 | Opsvik | 297/423.11 |
| D317,389 | S | * | 6/1991 | Penaluna et al. | D7/543 |
| 5,076,438 | A | | 12/1991 | Aronson | |
| 5,152,398 | A | | 10/1992 | Forestal et al. | |
| 5,186,507 | A | * | 2/1993 | Neidfeld | 294/172 |
| 5,323,910 | A | * | 6/1994 | van de Graaf, Jr. | 206/557 |
| 5,346,070 | A | | 9/1994 | McSpadden | |
| 5,429,266 | A | | 7/1995 | D'Oliveira et al. | |
| 5,465,671 | A | * | 11/1995 | Genest | 108/43 |
| 5,697,512 | A | * | 12/1997 | Brickley | 220/556 |
| 5,769,264 | A | * | 6/1998 | Lipkowitz | 220/575 |
| 5,797,495 | A | | 8/1998 | Lerrick | |
| D403,019 | S | * | 12/1998 | Bedol et al. | D19/88 |
| 5,971,139 | A | * | 10/1999 | Bradley | 206/217 |
| 6,129,235 | A | * | 10/2000 | Creske | 220/575 |
| 6,923,485 | B1 | * | 8/2005 | Bauswell | 294/3.5 |
| 6,986,308 | B1 | | 1/2006 | King et al. | |
| 7,021,221 | B2 | * | 4/2006 | Del Frari | 108/42 |
| 7,243,786 | B2 | * | 7/2007 | Sollazzo | 206/201 |
| 2005/0056192 | A1 | * | 3/2005 | Marchand | 108/43 |
| 2009/0065391 | A1 | * | 3/2009 | McEwin et al. | 206/557 |

* cited by examiner

*Primary Examiner* — Jose Chen
(74) *Attorney, Agent, or Firm* — Levine Bagade Han LLP

(57) ABSTRACT

A serving tray that enhances tray-stabilizing features useful to a server's abilities to load, carry, and unload a serving tray depending upon the specifics of the serving situation. The serving tray is stackable, assists drying, bacterial-growth minimizing, and jack-stand nesting. The serving tray provides for easy gripping and added stability by either right or left-handed users.

20 Claims, 5 Drawing Sheets

SERVING TRAY SYSTEMS

CROSS-REFERENCE TO RELATED APPLICATION

The present application is related to and claims priority from prior provisional application Ser. No. 60/943,904, filed Jun. 14, 2007, entitled "SERVING TRAY SYSTEMS", the contents of which is incorporated herein by this reference and is not admitted to be prior art with respect to the present invention by the mention in this cross-reference section.

BACKGROUND

This invention relates to providing a system for improved serving trays. More particularly, this invention relates to providing serving tray systems enhancing a server's abilities to load, carry, and unload a serving tray. It also relates to providing such serving tray systems with improved stacking, drying, bacterial-growth minimizing, jack-stand nesting, etc.

There is presently a need for a more efficient system of providing serving tray features enhancing a server's abilities to load, carry, and unload a serving tray. Serving trays would be more efficient and useful with improved tray-stabilizing features useful to servers, and usable by servers, with user-selective use-features depending upon the specifics of the serving situation.

OBJECTS AND FEATURES OF THE INVENTION

A primary object and feature of the present invention is to provide a system for serving trays, which overcomes the above mentioned problems. It is a further object and feature of the present invention to provide such a system whose structural features are useful to provide the enhanced functionality that servers find helpful. It is a further object and feature of the present invention to provide such a system to more efficiently load, carry, and unload a serving tray. A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a serving tray apparatus comprising: at least one arm-carrier structured and arranged to carry servable items supported along at least one arm of at least one server; at least one whole-hand grip structured and arranged to assist whole-hand gripping of such at least one arm-carrier while in use; and at least one contoured cradle structured and arranged to assist contoured-cradling of such at least one arm-carrier upon at least one contoured body portion of such at least one arm of such at least one server.

In accordance with another preferred embodiment hereof, this invention provides a serving tray apparatus comprising: at least one arm-carrier structured and arranged to carry servable items supported along at least one arm of at least one server; and at least one stabilizer structured and arranged to assist stabilizing such at least one arm-carrier; wherein such at least one stabilizer comprises at least one whole-hand grip structured and arranged to assist whole-hand gripping of such at least one arm-carrier while in use, and at least one contoured cradle structured and arranged to assist contoured-cradling of such at least one arm-carrier upon at least one contoured body portion of such at least one arm of such at least one server; and wherein such at least one stabilizer comprises at least three stabilizers located in at least three different locations on such serving tray apparatus.

Moreover, it provides such a serving tray apparatus wherein positioning of such at least one grip and such at least one cradle is structured and arranged to assist such at least one server to re-position such at least one tray from shoulder to biceps (or vice versa) while gripping at least one selected such at least one grip.

In accordance with another preferred embodiment hereof, this invention provides at least one serving tray apparatus comprising: at least one serving tray structured and arranged to carry servable items while supported along at least one arm of at least one server; wherein such at least one serving tray comprises at least one upper-portion structured and arranged to carry such servable items; and wherein such at least one serving tray comprises at least one under-portion comprising at least two hand-grippable bars. Additionally, it provides such an at least one serving tray apparatus wherein: such at least two hand-grippable bars comprises at least one first hand-grippable bar, and at least one second hand-grippable bar; such at least one first hand-grippable bar is structured and arranged to assist left-handed gripping; and such at least one second hand-grippable bar is structured and arranged to assist right-handed gripping.

In accordance with another preferred embodiment hereof, this invention provides at least one serving tray apparatus comprising: at least one serving tray structured and arranged to carry servable items while supported along at least one arm of at least one server; wherein such at least one serving tray comprises at least one upper-portion structured and arranged to carry such servable items; wherein such at least one serving tray comprises at least one under-portion comprising at least one hand-grippable bar; wherein such at least one serving tray comprises at least one peripheral edge; and wherein such at least one hand-grippable bar is located adjacent such at least one peripheral edge of such at least one serving tray. Also, it provides such an at least one serving tray apparatus wherein: such at least one hand-grippable bar comprises at least one first hand-grippable bar, and at least one second hand-grippable bar; such at least one first hand-grippable bar is structured and arranged to assist left-handed gripping; and such at least one second hand-grippable bar is structured and arranged to assist right-handed gripping.

In accordance with another preferred embodiment hereof, this invention provides at least one serving tray apparatus comprising: at least one serving tray structured and arranged to carry servable items while supported along at least one arm of at least one server; wherein such at least one serving tray comprises at least one upper-portion structured and arranged to carry such servable items; and wherein such at least one serving tray comprises at least one under-portion comprising at least one hand-grippable bar; and at least one contoured cradle structured and arranged to assist contoured-cradling of such at least one serving tray upon at least one contoured body portion of such at least one arm of such at least one server.

In addition, it provides such an at least one serving tray apparatus wherein such at least one upper-portion of such at least one serving tray is structured and arranged to decrease sliding tendency of such servable items when carried by such at least one upper-portion of such at least one serving tray. And, it provides such an at least on serving tray apparatus wherein such at least one upper-portion of such at least one serving tray comprises at least one anti-slide surface. Further, it provides such an at least one serving tray apparatus wherein such at least one serving tray comprises at least one peripheral edge structured and arranged to decrease tendency of such servable items to fall off of such at least one upper-portion of such at least one serving tray.

Even further, it provides such an at least one serving tray apparatus wherein such at least one peripheral edge comprises at least one raised lip. Moreover, it provides such an at least one serving tray apparatus wherein such at least one upper-portion of such at least one serving tray is structured and arranged to assist noise reducing when such servable items are in a process of contacting such at least one upper-portion of such at least one serving tray. Additionally, it provides such an at least one serving tray apparatus wherein such at least one under-portion of such at least one serving tray comprises a plurality of legs structured and arranged to assist stackability of a plurality of such at least one serving trays.

Also, it provides such an at least one serving tray apparatus wherein such plurality of legs comprises at least one spacer to assist fast enough drying to minimize bacterial growth within at least one such plurality of such at least one serving trays when stacked. In addition, it provides such an at least one serving tray apparatus wherein: such at least one under-portion comprises a plurality of legs; and such plurality of legs are structured and arranged so that, when such at least one serving tray is supported on a jack-stand, such plurality of legs may interlock with such jack-stand so as to form a stable structural assembly. And, it provides such an at least one serving tray apparatus wherein such plurality of legs of at least one under-portion of such at least one serving tray comprises at least one mechanical stop adapted to interlock with such jack-stand.

Further, it provides such an at least one serving tray apparatus wherein such at least one upper-portion comprises a plurality of stacking dimples structured and arranged to assist uniform stacking between such plurality of legs on such at least one under-portion when at least one such serving tray is stacked on at least one other such serving tray. Even further, it provides such an at least one serving tray apparatus wherein such at least one upper-portion of such at least one serving tray comprises a plurality of stacking dimples to increase stacking-alignment of at least two such at least one serving trays when in stacked relation.

Even further, it provides such an at least one serving tray apparatus wherein: such at least one hand-grippable bar comprises at least one first hand-grippable bar, and at least one second hand-grippable bar; such at least one first hand-grippable bar is structured and arranged to assist left-handed gripping; and such at least one second hand-grippable bar is structured and arranged to assist right-handed gripping.

DETAILED DESCRIPTION OF THE BEST MODES AND PREFERRED EMBODIMENTS OF THE INVENTION

Figure 1:
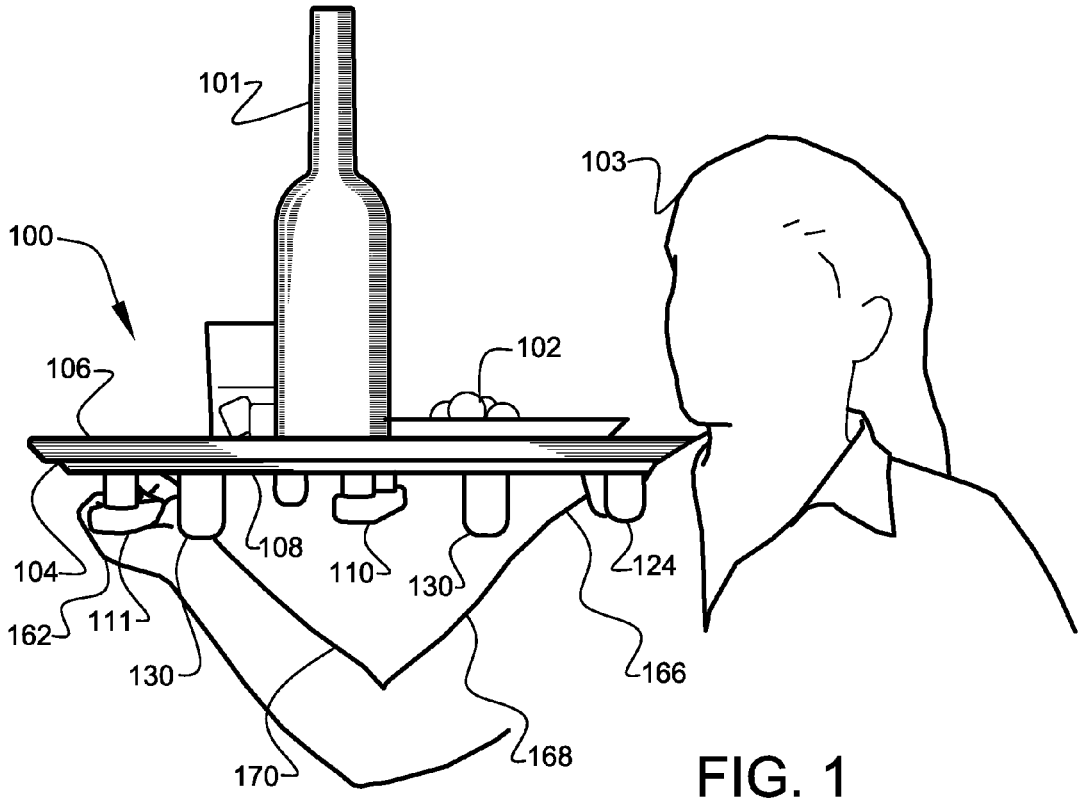
FIG. 1 shows a perspective view of a serving tray in use, according to a preferred embodiment of the present invention.

FIG. 1 shows a perspective view of a serving tray 100 in use, according to a preferred embodiment of the present invention. FIG. 1 shows a side view of serving tray 100, preferably useful for more efficiently serving customers, including carrying servable items such as either or both multiple beverage containers 101 and multiple food containers 102 from preparation areas to patrons in a beverage and food service venue. Serving tray 100 is preferably sized sufficiently large to accommodate such servable items as either or both multiple beverage containers 101 and multiple food containers 102, but preferably not so large that one person, server 103 for example, cannot readily control serving tray 100 due to weight of the servable items of the dimensions of such items. FIG. 1 also shows how server 103 may effectively use serving tray 100 to transfer a significant portion of the weight of the servable items carried by the tray (placed onto serving tray 100) onto shoulder 166 of server 103, as shown. In use, such weight transfer is preferably accomplished by server 103 resting cradle 124 on shoulder 166 of server 103 once server 103 has loaded serving tray 100 with such servable items, as shown. When cradle 124 is securely resting on shoulder 166 of server 103, then server 103, using one or both hands, may preferably effectively balance and guide serving tray 100 as server 103 maneuvers through patron areas or congested areas, as shown (at least embodying herein arm-carrier means for carrying servable items supported along at least one arm of at least one server; and at least embodying herein at least one arm-carrier structured and arranged to carry servable items supported along at least one arm of at least one server).

Figure 8:
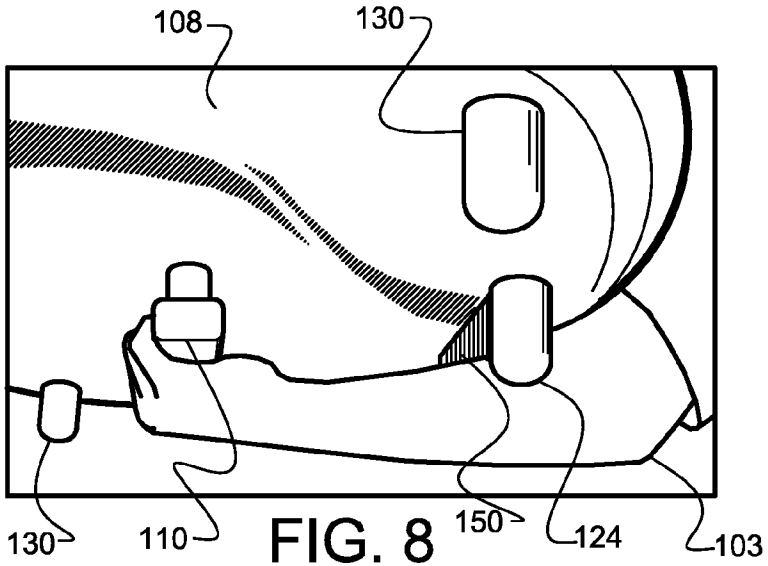
FIG. 8 shows a perspective view, illustrating a preferred hand placement during serving tray usage, according to the preferred embodiment of FIG. 1.

FIG. 8 shows a perspective view, illustrating a preferred hand placement during serving tray usage, according to the preferred embodiment of FIG. 1.

Preferably, when server 103 arrives at the proper patron table, server 103 may readily reposition serving tray 100 from shoulder 166 of server 103 to forearm 170 (at least embodying herein wherein positioning of such at least one grip and such at least one cradle is structured and arranged to assist such at least one server to re-position such at least one tray from shoulder to forearm while gripping at least one selected such at least one grip) of server 103, as shown. Repositioning as described above may preferably be accomplished by server 103 grasping either or both of center handle 110 and outer handle 111 with at least one hand, and lowering serving tray 100 and moving it from shoulder 166 of server 103 (see FIG. 1) then bringing serving tray 100 to rest on forearm 170 of server 103, as shown (see FIG. 8). This arrangement at least embodying herein whole-hand grip means for whole-hand gripping of such carrier means while in use; and at least embodying herein at least one whole-hand grip structured and arranged to assist whole-hand gripping of said at least one arm-carrier while in use).

When serving tray 100 is preferably securely positioned on forearm 170 of server 103 and further stabilized by server 103 grasping center handle 110 (see FIG. 8), server 103 may preferably utilize the other hand of server 103 to serve patrons the carried contents on the serving tray 100, as shown.

Preferably, cradle 124, center handle 110, and outer handle 111 are symmetrically arranged on bottom 108 (at least embodying herein stabilizer means for assisting stabilizing such arm-carrier means; and at least embodying herein wherein said at least one serving tray comprises at least one under-portion comprising at least two hand-grippable bars) of serving tray 100, so that serving tray 100 may preferably accommodate either right-handed or left-handed servers equally well, as shown.

Preferably, the size of serving tray 100 is scaled for ergonomic handling as shown in FIG. 1. Length B of serving tray 100, represented along centerline 152 in FIG. 3, preferably does not exceed a length that may be reasonably handled by a single server, which length B preferably is less than about three feet and preferably more than about one foot, as shown. More preferably, length B is about 2.5 feet, most preferably about 27 inches, as shown. Upon reading this specification, those with ordinary skill in the art will now appreciate that, under appropriate circumstances, considering such issues as design preference, user preferences, marketing preferences, cost, structural requirements, available materials, technological advances, etc., other dimensions such as, for example, greater or smaller, rounded, square, rectangular, etc., may suffice.

Figure 3:
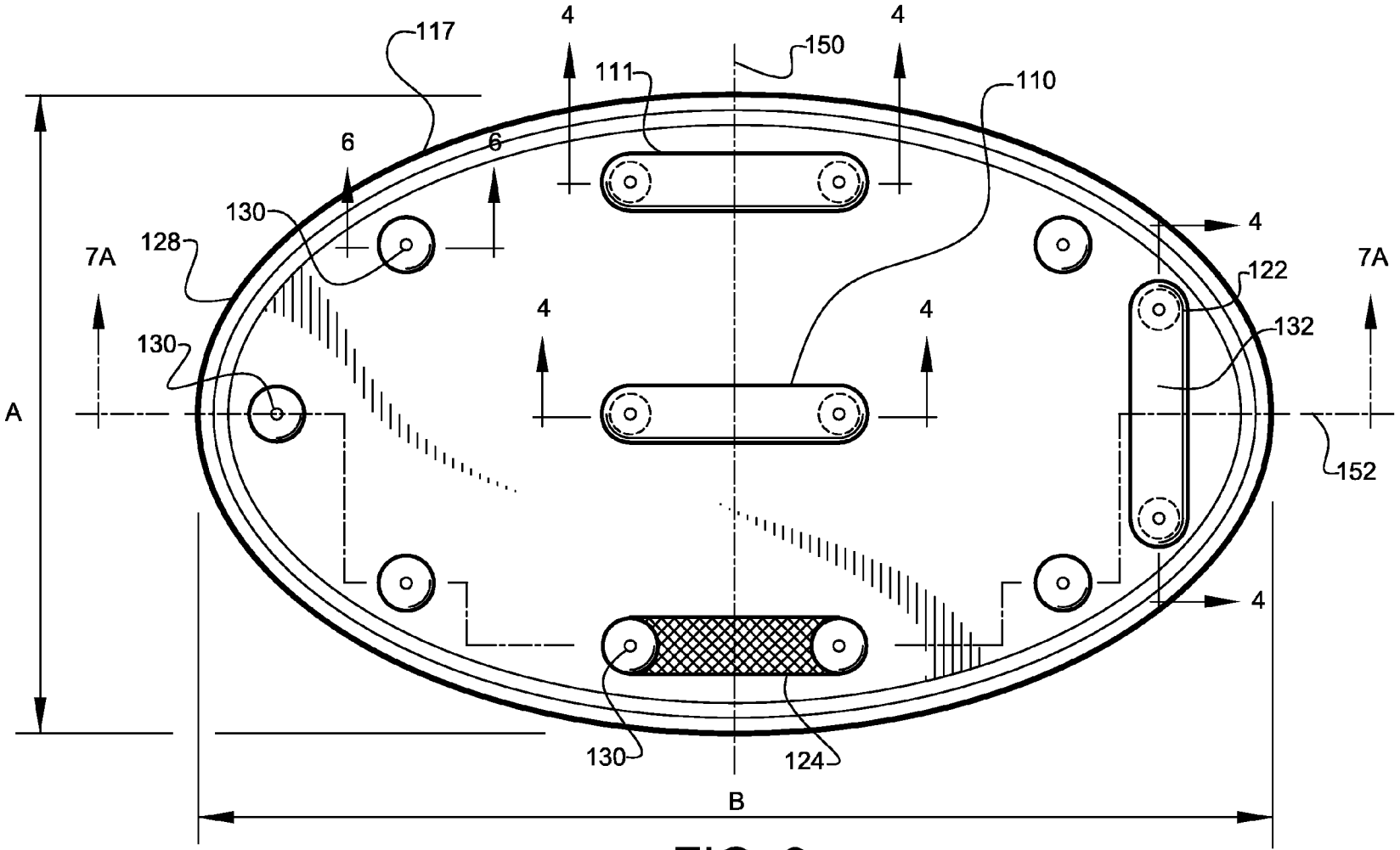
FIG. 3 shows a bottom view of the serving tray, according to the preferred embodiment of FIG. 1.

Width A of server tray 100, represented along centerline 150, as shown in FIG. 3, preferably is sized to ergonomically fit server 103, such that a large portion of adult servers can grasp either or both center handle 110 and outer handle 111 and lower serving tray 100 from shoulder 166 of server 103 and bring serving tray 100 to rest on forearm 170 of server 103 as previously described above. Preferably, width A is less than about three feet and preferably more than about one foot. More preferably, width A is about 2 feet, most preferably about 22 inches, as shown. Upon reading this specification, those with ordinary skill in the art will now appreciate that, under appropriate circumstances, considering such issues as design preference, user preferences, marketing preferences, cost, structural requirements, available materials, technological advances, etc., other dimensions such as, for example, greater or smaller, etc., may suffice.

Figure 2:
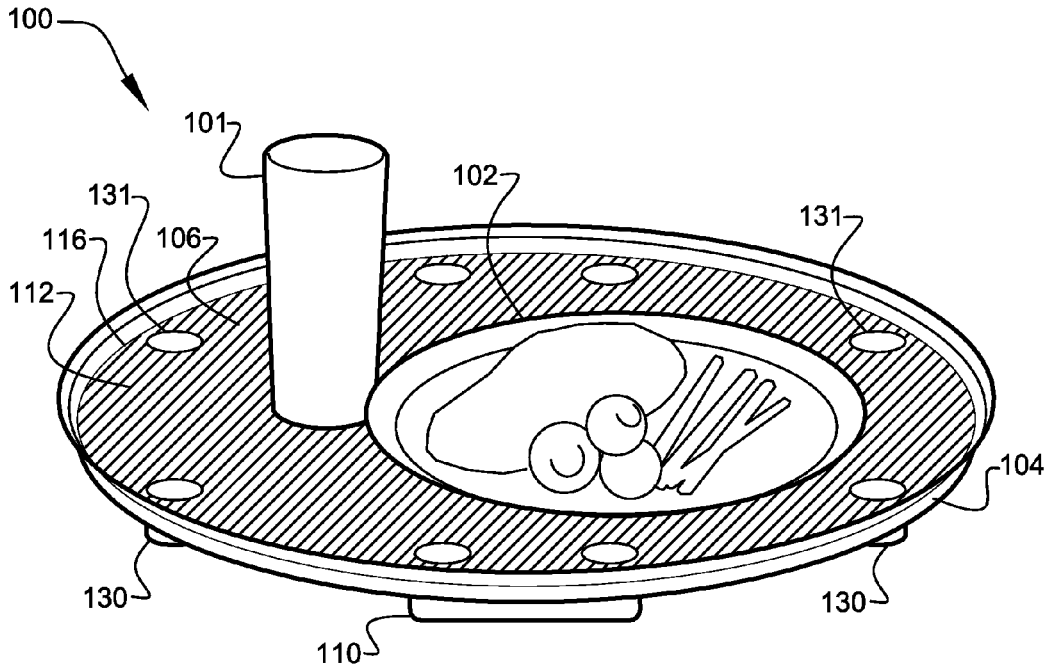
FIG. 2 shows a perspective view, of the top of a serving tray, according to the preferred embodiment of FIG. 1.

FIG. 2 shows tray top 106 and typical multiple beverage containers 101 and multiple food containers 102 that server 103 might deliver to patrons in a beverage/food service venue. Tray top 106 (at least embodying herein wherein said at least one serving tray comprises at least one upper-portion structured and arranged to carry such servable items), as shown, preferably comprises tray rim 114 (see FIG. 7) designed to assist prevention of items from falling completely off serving tray 100, (this arrangement at least embodies herein wherein at least one peripheral edge of said at least one serving tray is structured and arranged to decrease tendency of such servable items to fall off of said at least one upper-portion of said at least one serving tray). Tray top 106 preferably comprises an anti-skid hydrophobic surface 112 (at least embodying herein wherein such at least one upper-portion of such at least one serving tray is structured and arranged to decrease sliding tendency of such servable items when carried by such at least one upper-portion of such at least one serving tray), designed to minimize either or both multiple beverage containers 101 and multiple food containers 102 from sliding around tray top 106, whether tray top 106 is wet or dry, and as either or both multiple beverage containers 101 and multiple food containers 102 are carried to patrons in a beverage and food service venue. Upon reading this specification, those with ordinary skill in the art will now appreciate that, under appropriate circumstances, considering such issues as design preference, user preferences, marketing preferences, cost, structural requirements, available materials, technological advances, etc., other anti-skid materials and arrangements such as, for example, rubber surfacing, textured surfaces, friction surfaces, etc., may suffice.

Further, tray platform 104 is preferably constructed as a composite of materials, which together exhibit desirable characteristics as now described below. Preferably, included in tray platform 104 is thermal insulating material 118, preferably such that server 103 is protected from potential skin burns associated with very hot multiple beverage containers 101 or multiple food containers 102 that may be carried on the tray platform wherein such heat might transfer to the server 103. Tray platform 104, preferably comprises sound reducing material 116, preferably such that if a server 103 drops or places noisy items onto serving tray 100, such as plates, glasses, and flatware, noise from the items is reduced, preferably, adding to a relaxed atmosphere in the beverage or food service venue.

FIG. 3 shows a bottom view of the serving tray 100, according to the preferred embodiment of FIG. 1. FIG. 3 shows a view of the tray bottom 108 of serving tray 100. Also illustrated in FIG. 3 is peripheral edge 117 of serving tray 100, as shown. Tray bottom 108, as shown, preferably comprises center handle 110, outer handle 111, and cradle 124, as shown. Preferably, outer handle 111 is located closely adjacent the peripheral edge 117 of the serving tray 100 (at least embodying herein wherein such at least one hand-grippable bar is located adjacent such at least one peripheral edge of such at least one serving tray). Tray bottom 108 also preferably comprises gripper 122, for hand grip assisting, and a plurality of short legs 130, as shown. Server 103 may preferably effectively use gripper 122 (and alternately preferably gripper 190, having the same makeup as gripper 122, as shown and described with respect to FIG. 9) to both aid in balancing and maneuvering the combination of serving tray 100 and such items being held on such tray (for example, beverage containers 101 and food containers 102), as server 103 raises serving tray 100 to securely rest cradle 124 (at least embodying herein contoured cradle means for contoured-cradling of such carrier means upon at least one contoured body portion of such at least one arm of such at least one server) on the shoulder 166 of server 103, as shown (see FIG. 1). Also, server 103 may hand grasp gripper 122 and stabilize serving tray 100 as server 103 maneuvers through congested areas within the beverage and food service venue, as shown. Upon reading this specification, those with ordinary skill in the art will now appreciate that, under appropriate circumstances, considering such issues as design preference, user preferences, marketing preferences, cost, structural requirements, available materials, technological advances, etc., other gripping arrangements such as, for example, multiple server gripping, multiple hand gripping, gripping in combination with other devices, etc., may suffice.

In a preferred method of use, once server 103 arrives at the proper patron table, server 103 may readily reposition serving tray 100 from shoulder 166 of server 103 to forearm 170 of server 103 by preferably grasping gripper 122 and preferably stabilizing serving tray 100 with the help of gripper 122 while simultaneously preferably repositioning hand 162 of server 103 from center handle 110 to outer handle 111, as shown. At this point, server 103 may either continue in a fluid motion to lower serving tray 100 from shoulder 166 of server 103 and bring serving tray 100 to rest on forearm 170 of server 103 or may position serving tray 100 on at least one portable jack-stand 158 to assist stabilizing the serving tray 100 on such jack stand 158 (commonly used to assist serving in restaurants, etc.), as shown (see FIG. 7). Preferably, once serving tray 100 is securely positioned either on forearm 170 of server 103 or on such portable jack-stand 158, server 103 has freed both hands to serve patrons such servable items as either or both multiple beverage containers 101 and multiple food containers 102, as shown. Upon reading this specification, those with ordinary skill in the art will now appreciate that, under appropriate circumstances, considering such issues as restaurant preference, store use preference, customer preferences, user preference, available servable items carried by such serving tray, etc., other servable items such as, for example, cigars, candy, cards, flowers, gifts, condiments, etc., may suffice.

A plurality of short legs 130 are preferably located on tray bottom 108 such that they act as stabilizers by preferably bearing against portable jack-stand top support members 159. This mating of the plurality of short legs 130 against top support members 159 of portable jack-stand 158 minimizes a tendency for serving tray 100 to slide laterally off of portable jack-stand 158 when portable jack-stand 158 is not positioned on a horizontal surface, such as the venue floor, and/or when serving tray 100 is not symmetrically loaded with beverage containers 101 and multiple food containers 102. The plurality of short legs 130 is preferably symmetrically arranged on tray bottom 108 such that serving tray 100 may be placed on portable jack-stand 158 in any orthogonal orientation relative to top support member 159 of portable jack-stand 158, as shown (see FIG. 7). Upon reading this specification, those with ordinary skill in the art will now appreciate that, under appropriate circumstances, considering such issues as jack stand design preference, user preferences, structural requirements, available materials, technological advances, etc., other serving tray jack stand stabilizer arrangements such as, for example, other blocking element, indentations, clamps, couplers, etc., may suffice.

Figure 4:
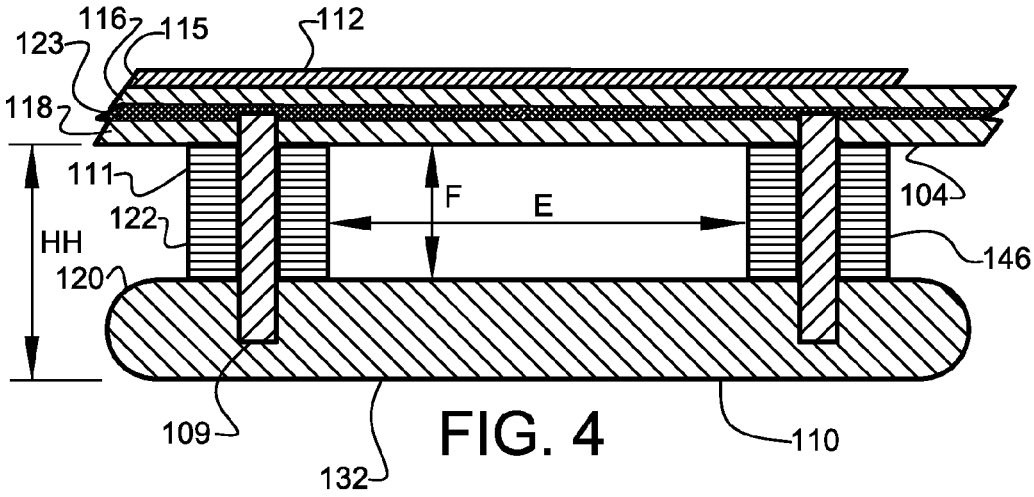
FIG. 4 shows a sectional view, through the section 4-4 of FIG. 3, according to the preferred embodiment of FIG. 1.

FIG. 4 shows a sectional view, through the section 4-4 of FIG. 3, according to the preferred embodiment of FIG. 1. FIG. 4 shows cross-sections through three different handle locations preferably comprising at least a center handle 110, outer handle 111, and gripper 122, wherein handle stand-off 146 preferably separates handle grip 120 from tray bottom 108 and is preferably attached to tray bottom 108 preferably by shaped attached rod 109, as shown. This arrangement provides room for a hand to fit between the Length F of handle stand-off 146 is preferably scaled for ergonomic handling, as shown in FIG. 1. Length F of handle stand-off 146 preferably is less than a length that is excessive for server 103 to maneuver hand 162 of server 103 under handle grip 120. A preferred length F of handle stand-off 146 is preferably less than about 1.5 inches and preferably more than about 0.75 inch, more preferably, about 1 inch, as shown. Upon reading this specification, those with ordinary skill in the art will now appreciate that, under appropriate circumstances, considering such issues as design preference, user preferences, marketing preferences, cost, structural requirements, available materials, technological advances, Darwinian growth of human appendages, etc., other dimensions such as, for example, greater than those stated above, etc., may suffice.

Preferably, handle stand-off 146 comprises a structurally sound polymer material, more preferably a moldable, non-porous, bondable, structurally sound polymer material, most preferably a polymer or co-polymer of high-density polypropylene or high-density polyethylene. Upon reading this specification, those skilled in the art will now appreciate that, under appropriate circumstances, considering such issues as structural characteristics, surface friction, manufacturability, etc., other materials such as composite structures, wood, metals, polyamide, polyimide, polyehterimide, polycarbonate, polyarylate, polysulfone, or polyphenylsulfine etc. may suffice.

Open space length E of handle grip 120 is scaled for ergonomic handling, as shown in FIG. 1. Preferably, open space length E of handle grip 120 does not exceed a size that is excessive for server 103 to maintain lateral control of serving tray 100 with hand 162 of server 103, as shown, but which also allows for the hands of most adult servers to readily be positioned under handle grip 120 and grasp handle grip 120, as shown. Preferably, open space length E of handle grip 120 is less than about 6 inches and preferably more than about 4 inches. More preferably, open space length E of handle grip 120 is about 5 inches, as shown.

Preferably, handle grip 120 is a structurally sound, high-dimensionally-stable polymer material, more preferably handle grip 120 is a moldable, structurally sound, high-dimensionally-stable polymer material. Most preferably, handle grip 120 is a polymer or co-polymer of high-density polypropylene or high-density polyethylene. Upon reading this specification, those skilled in the art will now appreciate that, under appropriate circumstances, considering such issues as dimensional stability, structural characteristics, manufacturability, etc., other materials such as composite structures, co-polymers, woods, metals, polyamide, polyimide, polyehterimide, polycarbonate, polyarylate, polysulfone, or polyphenylsulfine, etc. may suffice.

Multiple shaped attachment rods 109 attach center handle 110, outer handle 111, gripper 122, cradle 124, and the plurality of short legs 130 respectively to tray bottom 108, as shown. Length H of shaped attachment rod 109 is scaled as shown in FIG. 4 through FIG. 7, where shaped attachment rod 109 is embedded into tray platform 104 and also embedded into either center handle 110, outer handle 111, gripper 122, cradle 124, and the plurality of short legs 130, as shown. Shaped attachment rod 109 embedded length into tray platform 104 does not exceed thickness G of tray platform 104, such that tray top 106 is not characterized by a protrusion of shaped attachment rod 109, as shown. Shaped attachment rod 109 preferably is less than about 2 inches in length and preferably more than about 1 inch in length. More preferably, shaped attachment rod 109 is about 1.25 inches in length, as shown. Preferably, shaped attachment rod 109 is constructed of a metal, more preferably shaped attachment rod 109 is a bondable, structurally sound metal, more preferably shaped attachment rod 109 is a bondable, structurally sound metal that can be inserted into serving tray 100 during the manufacturing process of serving tray 100 and that mechanically and chemically bonds tray bottom 108 to center handle 110, outer handle 111, gripper 122, cradle 124, and the plurality of short legs 130, as shown. Preferably, shaped attachment rod 109 is a shaped aluminum alloy rod. Preferably shaped attachment rod 109 is shaped in such a fashion as to enhance both its mechanical fastening ability and chemical bonding ability, such as knurling, flanging, and similar surface and geometric shaping. Upon reading this specification, those skilled in the art will now appreciate that, under appropriate circumstances, considering such issues as bonding and structural characteristics, shaping for attaching, manufacturability, etc., other materials such as fiberglass, carbon whiskers, magnetic and non-magnetic steels, etc. may suffice. Alternately preferred, rod 109 is absent when sufficient structural support is provided by the selected material of the handles and selected material of the grippers.

Figure 5:
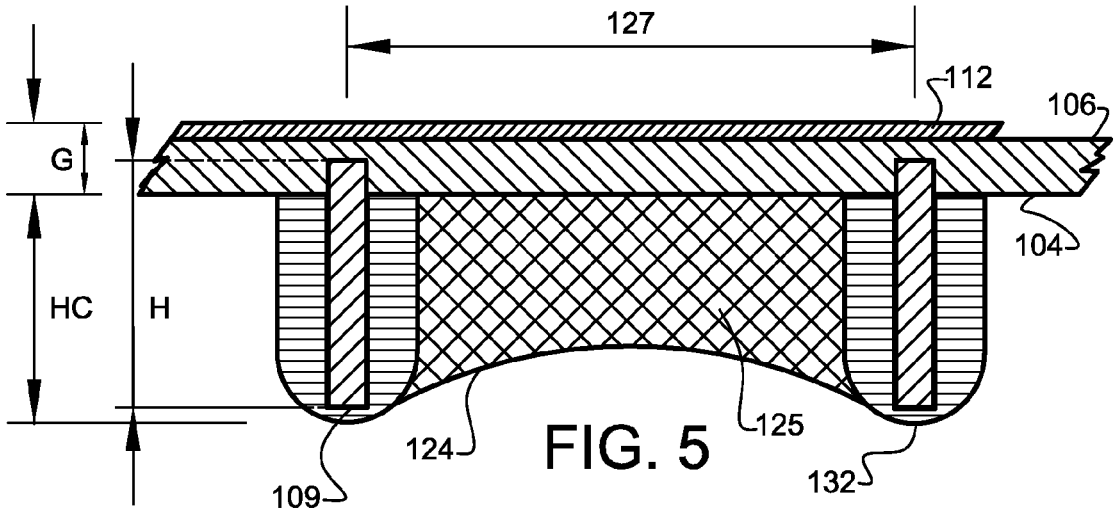
FIG. 5 shows a view of Detail 5 of FIG. 7A, according to the preferred embodiment of FIG. 1.
Figure 7B:
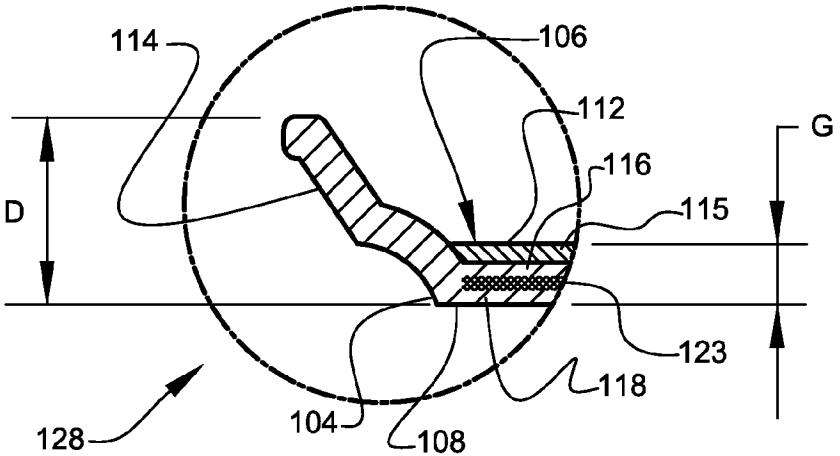
FIG. 7B shows a view of Detail 7B of FIG. 7A, according to the preferred embodiment of FIG. 1.
Figure 7A:
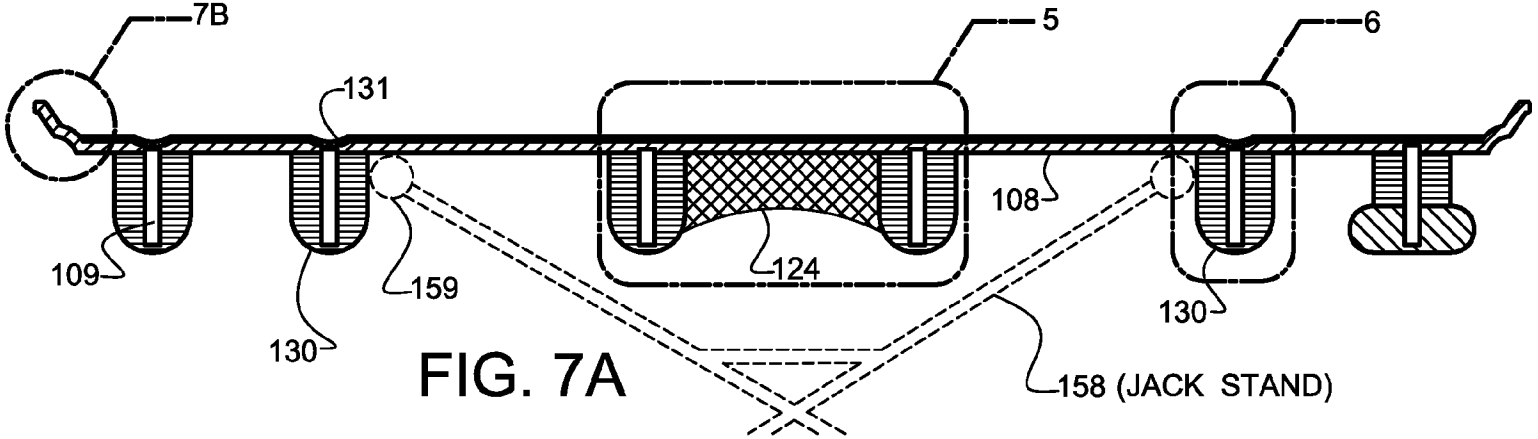
FIG. 7A shows full sectional view, through the section 7A-7A of FIG. 3, according to the preferred embodiment of FIG. 1.

FIG. 5 shows a view of Detail 5 of FIG. 7A, according to the preferred embodiment of FIG. 1. Cross-section of cradle 124, wherein cradle contoured section 125 is preferably shaped to generally conform to most servers' rounded shoulder 166 and rounded forearm 170, is scaled for ergonomic handling, as shown in FIG. 1. Length 127 of cradle 124 preferably does not exceed a length that is excessive for cradle contoured section 125 to conform to most servers' rounded shoulder 166 and rounded forearm 170, as shown, which preferably comprises less than 5 inches and preferably more than 3 inches. More preferably, length 127 of cradle 124 is about flinches. Preferably, cradle contoured section 125 comprises a molded closed-cell polymer foam, preferably a polyethylene or polyurethane molded closed-cell polymer foam. Upon reading this specification, those skilled in the art will now appreciate that, under appropriate circumstances, considering such issues as dimensional stability, resiliency and flexibility characteristics, high compression cycle-life, manufacturability, etc., other materials such as polyester closed-cell polymer, or co-polymer foam of polyethylene or polyurethane or polyester, other polymers, other co-polymers, etc. may suffice.

Figure 6:
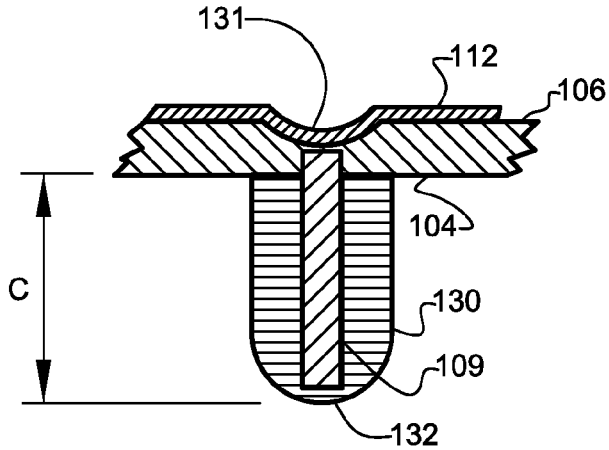
FIG. 6 shows a view of Detail 6 of FIG. 7A, according to the preferred embodiment of FIG. 1.

FIG. 6 shows a view of Detail 6 of FIG. 7A, according to the preferred embodiment of FIG. 1. FIG. 6, shows a cross-section of short legs 130, wherein short legs 130 are preferably shaped to conform to length C, and attached to tray bottom 108. Length C of short legs 130 preferably is greater than either: total height HH of center of handle 110; total height HH outer handle 111; or total height HC of cradle 124, as shown in FIG. 4. Length C of short legs 130 preferably does not exceed a length that is excessive for cradle contoured section 125 to conform to most servers' rounded shoulder and rounded forearm, as shown, and which is not excessive to maneuver hand 162 of server 103 under handle grip 120. Preferably, length C of short legs 130 is less than about 2 inches and preferably more than about 1 inch. More preferably, length C of short legs 130 is about 1.5 inches. Preferably, short legs 130 comprise a structurally sound, high-dimensionally-stable polymer material, preferably moldable. Most preferably, short legs 130 comprise a polymer or co-polymer of high-density polypropylene or high-density polyethylene. Upon reading this specification, those skilled in the art will now appreciate that, under appropriate circumstances, considering such issues as dimensional stability, structural characteristics, surface friction, manufacturability, etc., other materials such as composite structures, co-polymers, woods, polymer or co-polymer of polyamide, polyimide, polyehterimide, polycarbonate, polyarylate, polysulfone, or polyphenylsulfine, etc. may suffice.

A plurality of stacking dimples 131 in tray top 106, as shown in FIGS. 2, 6 and 7, are preferably positioned to align with the plurality of short legs 130. When two or more serving trays 100 are stacked vertically, the plurality of stacking dimples 131 and the plurality of short legs 130 preferably nest to provide lateral stability of a plurality of stacked serving trays 100. The plurality of short legs 130 also preferably create air-gaps between adjacent serving trays 100 that promote the rapid drying of serving tray 100 and thus minimize the likelihood of bacteria growth on serving tray 100. The nesting of stacking dimples 131 with the plurality of short legs 130 also preferably allows for the safe transport of a vertical stack of two or more serving trays 100 by a single server, serving cart, or in use with a jack-stand, without the likelihood of stacked serving trays 100 sliding off the remaining stack of two or more serving trays 100.

FIG. 7A shows full sectional view, through the section 7A-7A of FIG. 3, according to the preferred embodiment of FIG. 1. FIG. 7A shows cross-section 5-5 (see FIG. 3) of serving tray 100, resting on jack-stand 158, and showing how the plurality of short legs 130 are positioned to stabilize serving tray 100 on jack-stand 158 so that a respective short leg 130 "locks" the serving tray 100 onto the jack-stand 158 so as to prevent accidental sliding of the serving tray 100 while on the jack-stand 158, as shown.

FIG. 7B shows a view of Detail 7B of FIG. 7A, according to the preferred embodiment of FIG. 1. FIG. 7B shows a cross-section of outer edge 128 of serving tray 100; this cross-section shows tray rim 114, tray platform 104, with tray top 106, non-skid surface 112, sound absorbing material 116, with thermal insulating material 118, and with tray bottom 108. Tray rim 114 preferably consists of the same material as tray platform 104, as shown. Preferably, height D of tray rim 114 is sufficient to prevent either or both multiple beverage containers 101 and multiple food containers 102 from falling off serving tray 100, as either or both multiple beverage containers 101 and multiple food containers 102 are carried from areas of their preparation to patrons in a beverage and food service venue. Preferably, tray rim 114 is sufficiently flared outwardly at the top of tray rim 114, as shown, so that when either or both multiple beverage containers 101 and multiple food containers 102 are dropped near outer edge 128 of serving tray 100, dropped beverage containers 101 and multiple food containers 102 tend to be collected onto serving tray 100.

Tray thickness G of tray platform 104 preferably does not exceed a thickness that creates an excessive total weight of serving tray 100, as shown, but preferably provides the desired non-skid, structural, sound absorbing, and thermal insulating characteristics. Preferably, when coupled with the intrinsic structural, intrinsic sound absorbing properties, and intrinsic thermal insulting properties of materials of tray platform 104, resulting tray thickness G is no greater than about ¼ inch or no less than about ⅛ inch. More preferably, tray thickness G is about 3/16-inch thick, as shown.

Preferably, anti-skid material 115 has anti-skid surface 112 and constitutes a minor contribution to total tray thickness G, as shown (see FIG. 4). More preferably, anti-skid material 115 is a patterned film, having a high friction coefficient, hydrophobic and scuff-resistant surface properties, which can be laminated to, and which exhibits a high degree of adherence to, other materials that make up tray platform 104, as shown. Preferably, anti-skid material 115 is a high friction coefficient, hydrophobic, scuff-resistant polymer film, more preferably Shore A durometer range 35-85, neoprene rubber polymer film. Alternately preferably, non-skid material 115 is a high friction coefficient, hydrophobic, scuff-resistance polymer silicone or fluorocarbon film. Upon reading this specification, those skilled in the art will now appreciate that, under appropriate circumstances, considering such issues as friction coefficient, hydrophobic properties, scuff-resistance, film lamination, etc., other materials, such as acrylics, Nitrile®, ethylene propylene rubber, thermalplastic elastomers, etc. may suffice.

Preferably, structural material 123, sound absorbing material 116, and thermal insulating material 118 together provide desired characteristics of tray system 100 and comprise a composite of two or more materials 127, as shown. Preferably, anti-skid material 115 and such composite of two or more materials 127 are laminated into a single structure that constitutes tray platform 104 with tray rim 114, as shown.

Preferably, structural material 123 is formable, bondable, light weight, and stiff. Preferably, structural material 123 comprises aluminum, preferably the 6000 series of heat-treatable aluminum alloys. Upon reading this specification, those skilled in the art will now appreciate that, under appropriate circumstance, considering such issues as formability, bondability, lightness of weight, stiffness, structural strength, etc., mild steel, 5000 series of aluminum alloys, fiberglass mash, carbon whisker mash, etc. may suffice.

Preferably, sound-absorbing material 116 is a low-density polymer. More preferably, sound absorbing material 116 is bondable to structural material 123, bondable to anti-skid material 115, and a low-density acoustic foam polymer, preferably low density phenolic, melanine, or formaldehyde resin based acoustic foam polymer. Upon reading this specification, those skilled in the art will now appreciate that, under appropriate circumstances, considering such issues as sound absorbing characteristics, bonding strength to structural materials and to anti-skid materials, etc., other porous structures such as foams, honeycomb, etc., may suffice.

Preferably, thermal insulating material 118 is a low-density polymer. More preferably, thermal insulating material 118 is bondable to structural material 123, bondable to non-skid material 115, and low density thermal insulating foam polymer, preferably low-density phenolic, melanine, or formaldehyde resin-based thermal insulating foam polymer. Upon reading this specification, those skilled in the art will now appreciate that, under appropriate circumstances, considering such issues as thermal insulating characteristics, bonding strength to structural materials and to non-skid materials, etc., other porous structures, such as corrugations, honeycomb, etc., and other materials, such as ethylene copolymer, expanded polyethylene, polycarbonate, polyester, polyether, polyetherimide, polyimide, polyolefin, polypropylene, polyurea, and vinyl, etc., may suffice.

Figure 9:
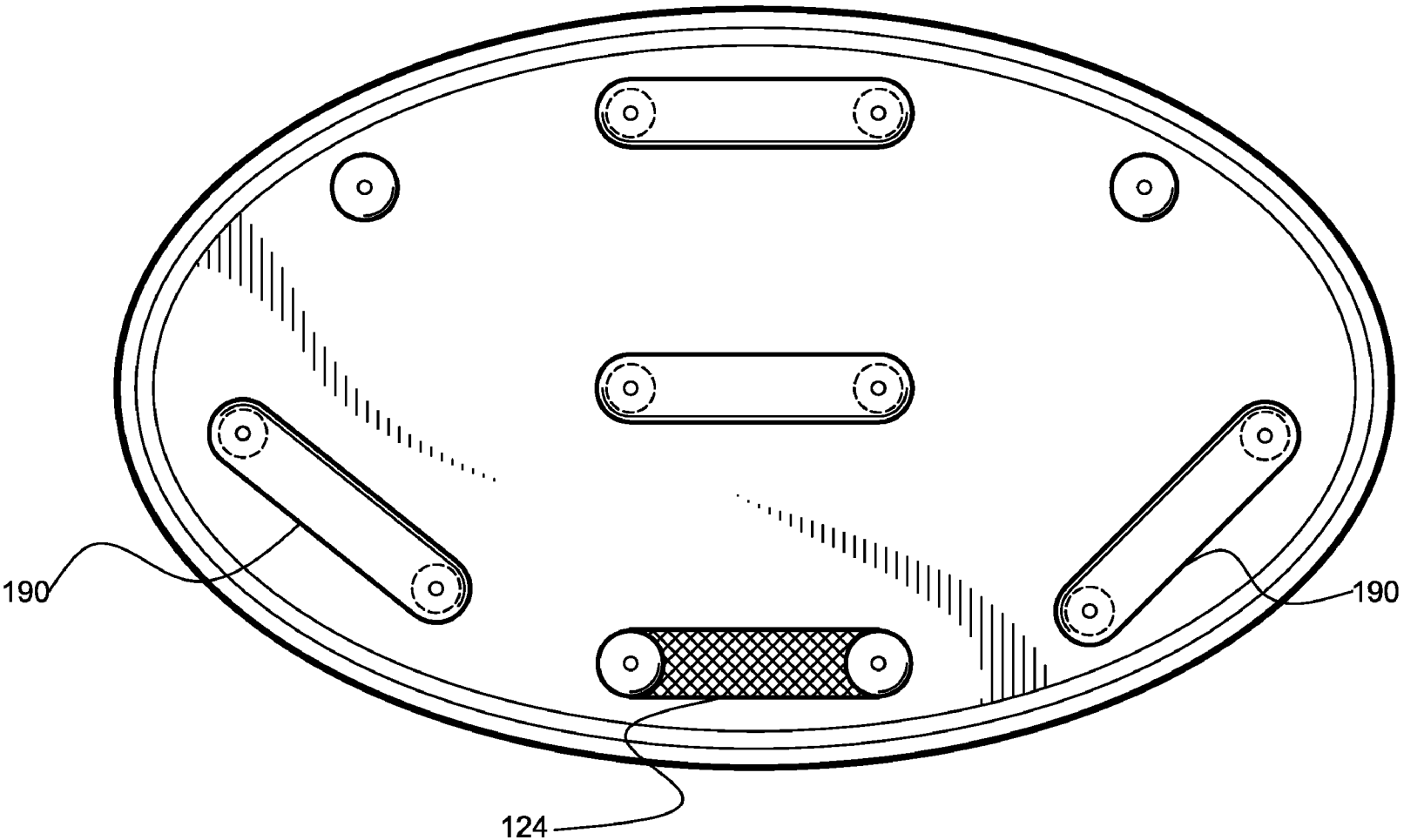
FIG. 9 shows a bottom view of another serving tray, according to an alternate preferred embodiment of the present invention.

FIG. 9 shows a bottom view of a serving tray, according to another preferred embodiment of the present invention. As shown in this alternate preferred embodiment, grippers 190 are preferably angled at an about forty-five degree angle relative to the orientation of cradle 124, as shown. Providing the two grippers in such an orientation allows both right-handed and left-handed servers to ergonomically utilize serving tray 100.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A serving tray apparatus comprising:

a) at least one arm-carrier structured and arranged to carry servable items;

b) at least one whole-hand grip attached to the at least one arm-carrier and arranged adjacent to a first portion of a peripheral edge of the at least one arm-carrier to assist whole-hand gripping of said at least one arm-carrier while in use;

c) at least one contoured cradle attached to the at least one arm-carrier and arranged adjacent to a second portion of the peripheral edge which is opposite to the first portion to assist contoured-cradling of said at least one arm-carrier; and d) a center handle positioned between the whole-hand grip and contoured cradle such that the whole-hand grip and contoured cradle are symmetrically arranged on the arm-carrier relative to the center handle.

2. A serving tray apparatus comprising:

a) at least one arm-carrier structured and arranged to carry servable items; and b) at least one stabilizer assembly structured and arranged to assist stabilizing said at least one arm-carrier;

c) wherein said at least one stabilizer assembly comprises i) at least one whole-hand grip attached to the at least one arm-carrier and arranged adjacent to a first portion of a peripheral edge of the at least one arm-carrier to assist whole-hand gripping of said at least one arm-carrier while in use, ii) at least one contoured cradle attached to the at least one arm-carrier and arranged adjacent to a second portion of the peripheral edge which is opposite to the first portion to assist contoured-cradling of said at least one arm-carrier; and iii) a center handle positioned between the whole-hand grip and contoured cradle such that the whole-hand grip and contoured cradle are symmetrically arranged on the arm-carrier relative to the center handle; and d) wherein said at least one stabilizer assembly further comprises at least three stabilizers located in at least three different locations on said serving tray apparatus.

3. The serving tray apparatus according to claim 2 further comprising a gripper positioned adjacent to a third portion of the peripheral edge.

4. At least one serving tray apparatus comprising:

a) at least one serving tray structured and arranged to carry servable items;

b) wherein said at least one serving tray comprises at least one upper-portion structured and arranged to carry such servable items; and c) wherein said at least one serving tray comprises at least one under-portion comprising at least three hand-grippable bars attached to the under-portion and arranged symmetrically relative to one another, where a first hand-grippable bar is positioned adjacent to a first portion of a peripheral edge and a second hand-grippable bar is positioned adjacent to a second portion of the peripheral edge opposite to the first portion, and a third hand-grippable bar is positioned between the first and second hand-grippable bar such that the first and second hand-grippable bars are symmetrically arranged relative to the third hand-grippable bar on the under-portion of the at least one serving tray.

5. The at least one serving tray apparatus according to claim 4 wherein the first hand-grippable bar is structured and arranged to assist left-handed gripping and the second hand-grippable bar is structured and arranged to assist right-handed gripping.

6. At least one serving tray apparatus comprising:

a) at least one serving tray structured and arranged to carry servable items;

b) a first hand-grippable bar attached to an under portion of the serving tray, wherein the first hand-grippable bar is located adjacent to a peripheral edge of said at least one serving tray and is comprised of a first handle grip separated from the under portion via at least one handle stand-off;

c) a second hand-grippable bar attached to the under portion of the serving tray, wherein the second hand-grippable bar is comprised of a second handle grip separated from the under portion via at least one handle stand-off; and d) a third hand-grippable bar attached to the under portion of the serving tray and positioned between the first and second hand-grippable bars, where the third hand-grippable bar is comprised of a third handle grip separated from the under portion via at least one handle stand-off and where each of the first and second hand-grippable bars is symmetrically arranged relative to the third hand-grippable bar along the under portion of the serving tray.

7. The at least one serving tray apparatus according to claim 6 wherein the second hand-grippable bar comprises a contoured cradle structured and arranged adjacent to the peripheral edge along the under portion at a position which is opposite to the first hand-grippable bar.

8. At least one serving tray apparatus comprising:

a) at least one serving tray structured and arranged to carry servable items;

b) a first hand-grippable bar attached to an under portion of the serving tray, wherein the first hand-grippable bar is located adjacent to a peripheral edge of said at least one serving tray;

c) at least one contoured cradle attached to the under portion of the serving tray and arranged adjacent to the peripheral edge along the under portion at a position which is opposite to the first hand-grippable bar to assist contoured-cradling of said at least one serving tray; and d) a center handle positioned between the first hand-grippable bar and contoured cradle such that the first hand-grippable bar and contoured cradle are symmetrically arranged relative to the center handle on under portion of the serving tray.

9. The at least one serving tray apparatus according to claim 8 wherein said at least one serving tray defines an upper portion which is structured and arranged to decrease sliding tendency of such servable items when carried by said at least one upper-portion of said at least one serving tray.

10. The at least on serving tray apparatus according to claim 9 wherein said upper-portion comprises at least one anti-slide surface.

11. The at least one serving tray apparatus according to claim 10 wherein said peripheral edge is structured and arranged to decrease tendency of such servable items to fall off of said at least one upper-portion of said at least one serving tray.

12. The at least one serving tray apparatus according to claim 11 wherein said at least one peripheral edge comprises at least one raised lip.

13. The at least one serving tray apparatus according to claim 8 wherein said at least one serving tray is structured and arranged to assist noise reducing when such servable items are in a process of contacting an upper-portion of said at least one serving tray.

14. The at least one serving tray apparatus according to claim 8 wherein said under-portion comprises a plurality of legs structured and arranged to assist stackability of a plurality of said at least one serving trays.

15. The at least one serving tray apparatus according claim 14 wherein said plurality of legs comprises at least one spacer to assist fast enough drying to minimize bacterial growth within at least one such plurality of said at least one serving trays when stacked.

16. The at least one serving tray apparatus according to claim 14 wherein an one upper-portion of the serving tray defines a plurality of stacking dimples which correspond to a location of the plurality of legs on said under-portion.

17. The at least one serving tray apparatus according to claim 8 further comprising a plurality of legs extending from the under portion.

18. The at least one serving tray apparatus according to claim 17 further comprising a jack-stand, wherein said plurality of legs comprise at least one mechanical stop adapted to interlock with the jack-stand.

19. The at least one serving tray apparatus according to claim 8 further comprising a third hand-grippable bar attached to the under portion adjacent to the peripheral edge.

20. The at least one serving tray apparatus according to claim 19 wherein the first or second hand-grippable bar is comprised of a handle grip separated from the under portion via at least one handle stand-off.

* * * * *